United States Patent [19]

Griffith

[11] Patent Number: 4,962,930

[45] Date of Patent: Oct. 16, 1990

[54] METHOD AND APPARATUS FOR CASTING AN I CHING HEXAGRAM

[76] Inventor: Adrian L. Griffith, 6369 N. Paulina, Chicago, Ill. 60626

[21] Appl. No.: 387,775

[22] Filed: Aug. 1, 1989

[51] Int. Cl.[5] ..... A63F 9/00

[52] U.S. Cl. ..... 273/146; 273/161

[58] Field of Search ..... 273/146, 161

[56] References Cited

U.S. PATENT DOCUMENTS

| | | | |
|---|---|---|---|
| 2,247,250 | 6/1941 | Patterson | 273/153 R X |
| 3,580,582 | 5/1971 | Calamvotsakis | 273/146 X |
| 3,603,593 | 9/1971 | Chew | 273/146 X |

FOREIGN PATENT DOCUMENTS

| | | | |
|---|---|---|---|
| 213695 | 2/1955 | Australia | 273/146 |

*Primary Examiner*—Edward M. Coven
*Assistant Examiner*—Raleigh W. Chiu
*Attorney, Agent, or Firm*—Kinzer, Plyer, Dorn, McEachran & Jambor

[57] ABSTRACT

This invention concerns a method and apparatus for casting the six lines of an I Ching hexagram in a single throw. The apparatus consists of a set of six dies, each of a different color. Each color denotes the position of one of the lines in the hexagram. The dies also have indicia on the faces thereof which denote one of the types of lines of an I Ching hexagram. The two unchanging lines are each represented twice on each die, and the two changing lines are represented once. The set of dies is thrown once and the dies are arranged in order in a color-coded box. The indicia on the arranged dies determine the hexagram.

9 Claims, 1 Drawing Sheet

Fig. 1.
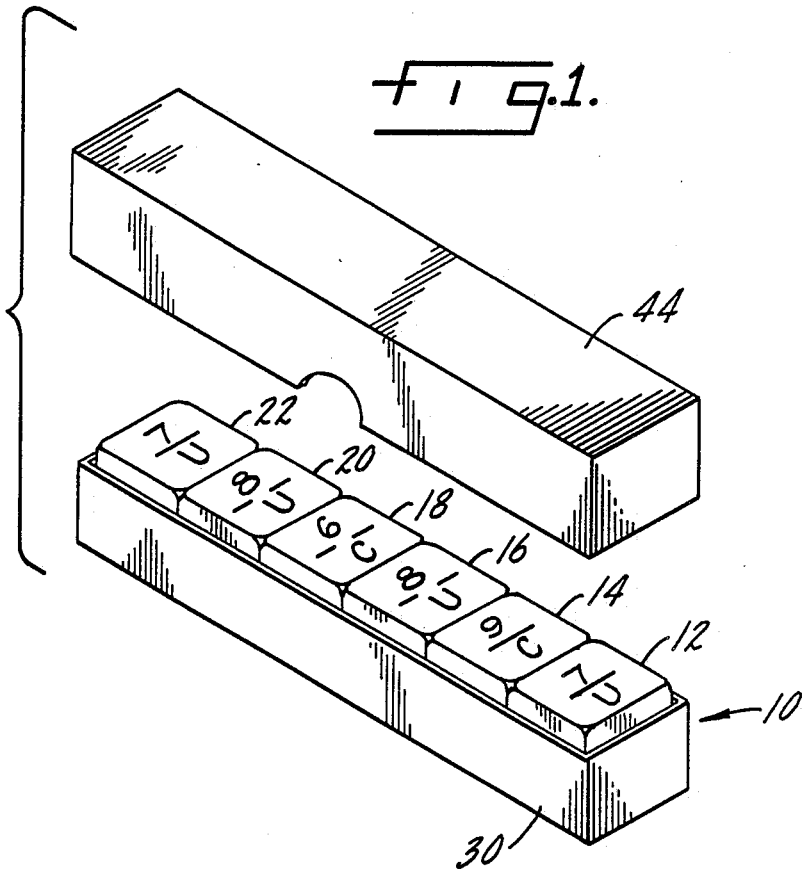
Fig. 2.
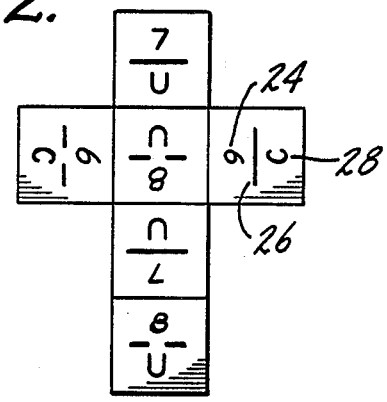
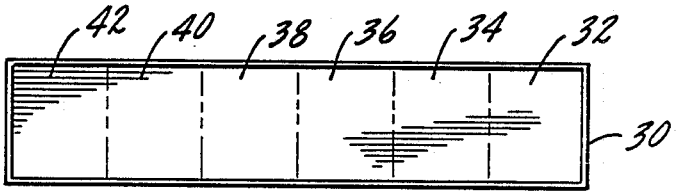
Fig. 3.

METHOD AND APPARATUS FOR CASTING AN I CHING HEXAGRAM

BACKGROUND OF THE INVENTION

This invention relates to a divination tool based on the ancient Chinese method known as "I Ching" or "Book of Changes". A brief explanation of this system of divination is given in the book "Introduction to the I Ching", by Tom Riseman, published by the Aquarian Press of Wellingborough, Northamptonshire. Another reference book on the subject is "The I Ching on Business & Decision Making", by Guy Damian-Knight, published by Destiny Books of Rochester, Vt.

In order to consult the I Ching or Book of Changes, the user must have a question in mind while casting or throwing the lines of a hexagram. In its simplest sense a hexagram is a pattern of six horizontal lines arranged vertically. The lines are designated as either changing or unchanging and may be either solid or broken. Once the hexagram is determined, the user can look up the proper answer in any one of many existing books on the subject.

As stated in the Damian-Knight book, there are a variety of ways of creating a hexagram. The ancient, meditative system uses 50 yarrow stalks, and is the method preferred by traditionalists who recognize the I Ching as an intuitive tool. This is a relatively lengthy process. The most widely used system involves throwing three coins six times. Heads is given a value of three and tails has a value of two. For each of the six throws, the values are added. In each case, they will always be 6, 7, 8 or 9. The 6's and 9's represent changing lines, while the 7's and 8's represent unchanging lines.

SUMMARY OF THE INVENTION

The present invention consists of a set of six dies, each marked with first and second indicia for indicating both the position of a line in the hexagram and the type of line. Unlike the previous methods used to generate a hexagram, the present invention is thrown only once. When the dies are assembled in the proper order, they immediately show the hexagram answer. The user can then look up the proper answer in an I Ching book. To assist in assembling the dies in the proper order, a box is provided with color coding matching the colors on the dies. Arranging the dies in the box in the corresponding color order determines the hexagram. The box also provides a convenient carrying case.

Because the present invention requires only one throw to derive answers, the user has better focus and concentration than ever before. This also simplifies the procedure to the point that anyone can use this philosophy for guidance and advice, whereas up to now it has been the domain of a minority of intellectuals in our society.

BRIEF DESCRIPTION OF THE DRAWINGS

FIG. 1 is a perspective view of a set of six dies according to the present invention, arranged in an alignment box.

FIG. 2 is a diagram of the faces of a die, in an unfolded arrangement, showing the second indicia as they would appear on each die.

FIG. 3 is a plan view of the alignment box.

DETAILED DESCRIPTION OF THE INVENTION

The apparatus for casting the six lines of an I Ching hexagram is shown generally in FIG. 1 at 10. The apparatus includes a set of six dies 12–22. Each die has a first indicia which denotes the position of one of the lines in a hexagram. In a preferred embodiment the first indicia comprises coloring or color coding which denotes the correct position. For example, the dies 12–22 could be colored green, blue, purple, red, orange and yellow, respectively. Alternatively, the dies could have an indicator on one or more faces thereof such as a simple numeral, indicating which line that die represents.

Each die further includes second indicia denoting one of the types of lines of an I Ching hexagram. This is best shown in FIG. 2. The second indicia includes a numeral portion 24, a line portion 26 and a letter designator 28. The numeral portion 24 is one of the numerals 6 through 9, corresponding to the well-known method of casting coins. The line portion 26 is either a solid or broken line. Finally, the letter portion 28 is a letter C or U indicating whether the line is changing or unchanging. FIG. 2 shows the indicia as they appear on each face of a die. FIG. 2 illustrates a die in an unfolded condition. If the representation of FIG. 2 were folded into a cube, the second indicia would have the indicated orientation.

The apparatus includes an alignment means for arranging the thrown dies in the correct order by placing the dies thereon. In the preferred embodiment, the alignment means is an elongated, rectangular box, as shown in FIGS. 1 and 3 at 30. The box has a width more or less matching the side of one of the dies. Its length is sufficient to accommodate six dies. The box has indicia on its inside bottom wall matching that of the first indicia of the dies. In the preferred embodiment wherein the dies are color coded, matching color coding is provided on the bottom of the box. Thus, the portions 32–42 of the box are similarly colored to match the coloring of the dies 12–22. After the user has thrown the dies, the die 12 is placed on top of portion 32 of the box 30. Die 14 would be placed on portion 34 and so on. It will be understood that if alternate forms of first indicia were placed on the dies, corresponding indicia could be placed on the box to assist in assembling the dies in the proper order.

For convenience, a lid 44 may be provided to retain the dies in the box 30 when not in use. The exterior of the box 30 and lid 44 may also include the color coding, if it is used.

The use of the invention is as follows. The user throws the set of dies one time, while having a question in mind. The dies are then placed in the box 30 in an order determined by matching the first indicia on the dies with the corresponding indicia in the box. The second indicia on the upper faces of the dies determine the type of each line of the hexagram. With the hexagram so determined, the user consults an I Ching book to interpret the meaning of the hexagram.

Whereas a preferred form of the invention has been shown and described, it will be understood that alterations could be made thereto without departing from the scope of the following claims.

I claim:

1. For casting the six lines of an I Ching hexagram in a single throw, a set of six dies each bearing a first indicia to denote the position of one of said lines in a hexagram, each die further having second indicia visible on the faces thereof, said second indicia denoting one of the types of lines of an I Ching hexagram, and further comprising alignment means for arranging the thrown dies in the correct order by placing the dies thereon.

2. The apparatus of claim 1 wherein the first indicia comprise color coding of the dies such that each die has a different color.

3. The apparatus of claim 1 wherein the second indicia are chosen such that the two unchanging lines of I Ching are each represented twice on each die, and the two changing lines of I Ching are each represented once on each die.

4. The apparatus of claim 1 wherein the first indicia comprise color coding of the dies such that each die has a different color and wherein the alignment means is color-coded to match the colors of the first indicia.

5. The apparatus of claim 4 wherein the alignment means comprises a rectangular box having color-coding corresponding to the colors of the dies.

6. The apparatus of claim 5 wherein the box is elongated and sized to contain the set of dies in a row.

7. The apparatus of claim 5 further comprising a lid for the box to retain the dies when not in use.

8. A method of casting the six lines of an I Ching hexagram, comprising the steps of marking each die of a set of six dies with first indicia, each die representing a position of one of said lines in a hexagram, marking the faces of each die with second indicia representing one of the four types of I Ching lines, and casting the dies in a single throw with the second indicia on the upper surface of each die determining the type of line and the first indicia of the die determining the position of said line type for each of the six lines of the hexagram, and further comprising the steps of providing alignment means for indicating the correct arrangement of the dies according to the first indicia, and placing the dies on the alignment means in the arrangement indicated thereon.

9. The method of claim 8 further characterized in that the first indicia comprise color coding of the dies such that each die has a different color.

* * * * *